US005651225A

United States Patent [19]

Leeks

[11] Patent Number: 5,651,225

[45] Date of Patent: Jul. 29, 1997

[54] DEVICE AND METHOD FOR JOINING AND SUPPORTING PIECES OF SHEET MATERIAL

[76] Inventor: Allan T. Leeks, 4219 Glenn Dale Rd., Bowie, Md. 20720-3538

[21] Appl. No.: 551,284

[22] Filed: Oct. 31, 1995

[51] Int. Cl.[6] ..... E04B 1/38; E04B 2/92

[52] U.S. Cl. ..... 52/461; 52/468; 52/514.5; 403/393; 403/384

[58] Field of Search ..... 52/417, 514.5, 52/468, 461; 403/393, 384

[56] References Cited

U.S. PATENT DOCUMENTS

| | | | |
|---|---|---|---|
| 45,723 | 1/1865 | Kingman | 52/468 X |
| 788,538 | 5/1905 | Kasch et al. . | |
| 1,220,219 | 3/1917 | Goldman . | |
| 1,639,072 | 8/1927 | Betz . | |
| 2,043,519 | 6/1936 | Rowe | 52/461 |
| 2,050,503 | 8/1936 | Ray . | |
| 2,137,911 | 11/1938 | Innocenti . | |
| 2,158,732 | 5/1939 | Shannon | 52/461 |
| 2,574,667 | 11/1951 | Shuman . | |
| 2,676,365 | 4/1954 | Price . | |
| 2,814,080 | 11/1957 | Tvorik et al. . | |
| 3,300,933 | 1/1967 | Donahue | 52/417 X |
| 3,576,091 | 4/1971 | Shull | 52/417 X |
| 3,599,384 | 8/1971 | Carlson et al. . | |
| 3,890,752 | 6/1975 | Bolton . | |
| 3,943,678 | 3/1976 | Ehrenberg et al. | 52/461 |
| 4,033,084 | 7/1977 | Shiflet . | |
| 4,055,930 | 11/1977 | Weinar et al. . | |
| 4,432,181 | 2/1984 | Funaki . | |
| 4,617,772 | 10/1986 | Hassell . | |
| 4,825,612 | 5/1989 | Tupman . | |
| 5,311,717 | 5/1994 | Yount et al. . | |
| 5,413,444 | 5/1995 | Thomas et al. | 411/387 |

FOREIGN PATENT DOCUMENTS

| | | | |
|---|---|---|---|
| 151994 | 4/1951 | Australia | 52/461 |

*Primary Examiner*—Anthony Knight
*Attorney, Agent, or Firm*—Wigman, Cohen, Leitner & Myers, P.C.

[57] ABSTRACT

A method and device for joining two pieces of sheet material using a unique joinder device are disclosed. The joinder device comprises first and second flange portions and a rib disposed between and interconnecting the flange portions. The rib extends in a direction perpendicular to a plane of the flange portions so that, when the joinder device is employed to join two pieces of sheet material, each of the flange portions lies flat against an interior side of the pieces of sheet material and the rib is disposed between the adjacent, abutting ends of the pieces of sheet material. Fasteners are driven from an exterior side of, and through, the pieces of sheet material so that distal ends of the fasteners are anchored in holes which are preformed in the first and second flange portions.

13 Claims, 1 Drawing Sheet

DEVICE AND METHOD FOR JOINING AND SUPPORTING PIECES OF SHEET MATERIAL

TECHNICAL FIELD

The present invention relates to a device and method for joining pieces of sheet material (for example, sections of wall board, drywall, plywood or the like).

BACKGROUND ART

In the field of construction in general, and in the construction and repair of walls and ceilings in particular, a common problem relates to the joining together of two adjacent sections of wallboard, drywall, plywood or the like into a contiguous, non-broken wall or ceiling. If a contiguous non-broken wall is not obtained, the fact that work has been done will not be hidden from the viewer, and the customer will not be satisfied.

Another problem in this area of construction results from the fact that, when two or more sections of sheet material are joined together, the point of joinder of the sheets of material often does not fall on or coincide with a supporting stud or beam. As a result, proper support for the sheet material is not obtained. This problem is especially prevalent when repairing holes in existing sheet material with other pieces of sheet material cut to the size of the hole being repaired. That is to say, quite often in such cases, the perimeter of the hole being repaired does not correspond with a supporting stud or beam, so that there is no support provided for the sheet material which is to be joined to the existing sheet material along the perimeter of the hole being repaired.

Thus, there is a need in the construction business for a method and device for joining pieces of sheet material in such a manner as to provide a contiguous non-broken wall so that the fact that work has been done in that area can be easily concealed from the viewer. There is also a need in the field of construction for a method and device for joining pieces of sheet material in such a manner as to provide support for the resulting combined structure, even in the absence of a supporting beam or stud at the location of the joinder.

DISCLOSURE OF INVENTION

The present invention generally relates to a device and method for joining two pieces of sheet material (such as wall board, drywall, plywood or the like).

More particularly, the invention relates to a method and device for joining two pieces of sheet material wherein the device comprises first and second flange portions and a rib disposed between and interconnected with the first and second flange portions, the rib extending in a direction perpendicular to a plane of the first and second flange portions. In accordance with the invention, the device further comprises a plurality of fasteners (such as rivets, drywall screws, or the like), one for each of the two pieces of sheet material being joined, for interconnecting the two pieces of sheet material by passing from an exterior side of the sheet material, through the sheet material preferably to a hole or holes preformed in the first and second flange portions.

Preferably, the length of the rib is less than the thickness of the sheet material, and the screws are fastened so as to become seated flush with the interior surface of the sheet material, resulting in a structure in which the joinder between the adjacent pieces of sheet material can be easily hidden.

Therefore, it is an object of the present invention to provide a device and method for joining two pieces of sheet material.

It is an additional object of the present invention to provide a device for joining two pieces of sheet material having first and second flange portions and a rib disposed between and interconnecting those portions.

It is an additional object of the present invention to provide a method and device for joining two pieces of sheet material, wherein a plurality of fasteners, one for each of the pieces of sheet material, interconnects the pieces of sheet material to the first and second flange portions, respectively.

It is an additional object of the present invention to provide a device and method for joining two pieces of sheet material, wherein the dimensions of the rib are such that the point of joinder between the two pieces of sheet material can be easily hidden from view once the job is completed.

It is an additional object of the present invention to provide a device and method for joining two pieces of sheet material, wherein the plurality of fasteners is positioned and dimensioned so that the fact that the pieces of sheet material have been joined together can be easily hidden from the viewer.

The above and other objects, and the nature of the invention, will be more clearly understood by reference to the following detailed description, the accompanying drawings, and the appended claims.

BEST MODE FOR CARRYING OUT THE INVENTION

The invention will now be described in more detail with reference to the various figures of the drawings.

Figure 1:
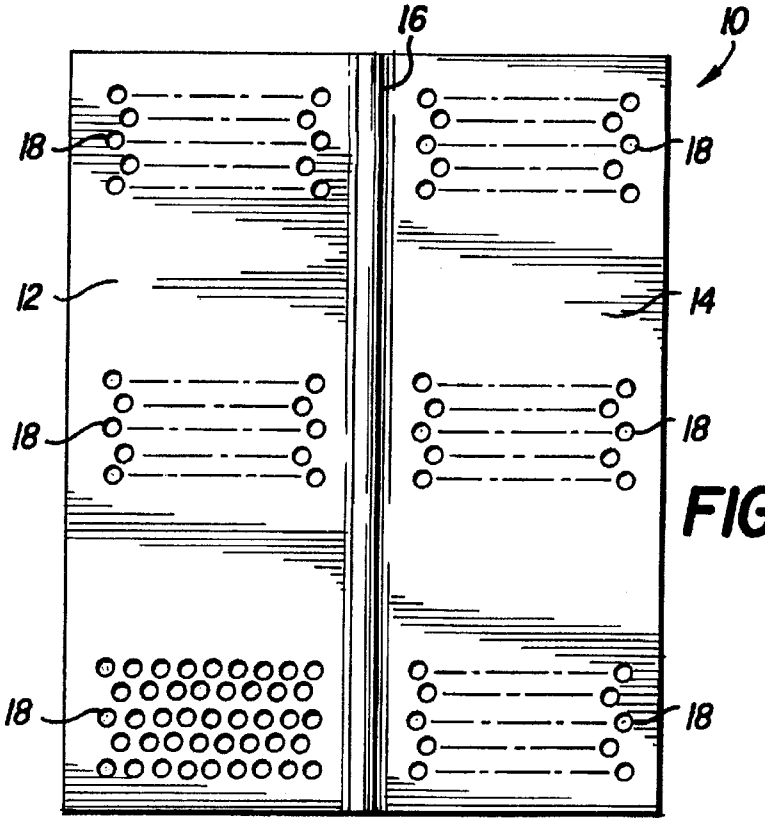
FIG. 1 is a plan view of a device for joining two pieces of sheet material in accordance with the present invention.
Figure 2:
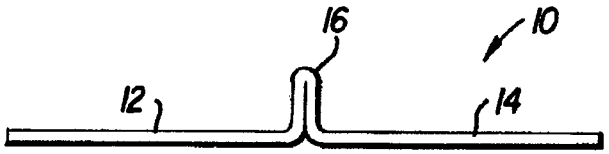
FIG. 2 is a side, cross-sectional view of the device of FIG. 1.

FIG. 1 is a plan view of the device of the present invention, while FIG. 2 is a side-cross-sectional view of the device of FIG. 1. As seen therein, the joining device (or joining bee) 10 basically comprises flange portions 12 and 14 interconnected by a rib portion 16. As best seen in FIG. 1, in a preferred embodiment of the invention, perforations or holes 18 for receiving the ends of fasteners (to be discussed below) are pre-formed in the flange portions 12 and 14.

The device and method for joining two pieces of sheet material will now be described in more detail with reference to FIGS. 3 and 4 of the drawings, which are side, cross-sectional views of the device of the present invention utilized to join two pieces of sheet material.

Figure 3:
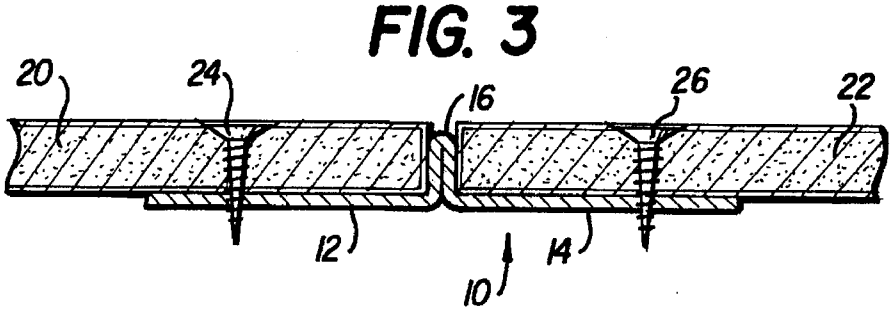
FIG. 3 is a side, cross-sectional view of the device of the present invention as employed, with a plurality of fasteners, to join two pieces of sheet material.
Figure 4:
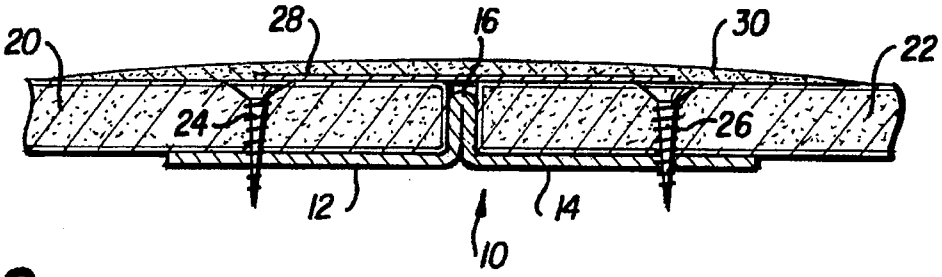
FIG. 4 is a side, cross-sectional view of the device of the present invention, as employed to interconnect two pieces of sheet material, in its final state, including provision of means for hiding the joinder of the two pieces of sheet material from the viewer.

Referring to FIGS. 3 and 4, when a person desires to join pieces 20 and 22 of sheet material, the device 10 is positioned so that flange portions 12 and 14 lie flat against an interior side of sheet material pieces 20 and 22, respectively, and so that the rib portion 16 of the device 10 is sandwiched between abutting ends of the sheet material pieces 20 and 22. In order to permanently connect sheet material pieces 20 and 22, fasteners 24 and 26 are driven through pieces 20 and 22, respectively, so that the distal ends of the fasteners 24 and 26 become screwed into holes 18 (see FIG. 1) formed in flange portions 12 and 14 respectively of the device 10. As indicated previously, any number of holes or no holes 18 may be formed in the flange portions 12 and 14 of the device 10, but preferably several groups of clustered holes 18 are formed therein, and this facilitates the use and connection of the device 10 to the sheet material pieces 20 and 22 by a person of less skill, that is, a person who does not work in the construction business on a routine basis. In addition, as would be obvious to a person of ordinary skill in the art, sheet material pieces 20 and 22 can have pre-formed holes or perforations contained in a portion adjacent to their abutting ends so as to facilitate the insertion of the fasteners 24 and 26; on the other hand, since sheet material pieces 20 and 22 can be wallboard or drywall, or other easily penetrated material, it is not absolutely necessary that preformed holes or perforations be provided in the pieces 20 and 22.

Referring to FIG. 4, once the device 10 and the pieces 20 and 22 are permanently interconnected via fasteners 24 and 26, the pieces 20 and 22 are ready for the finishing process. In that regard, it should be noted that, in accordance with the present invention, the ribbed portion 16 is preferably of a length less than the thickness of the pieces 20 and 22 being joined, so that, when the device 10 is interconnected with the pieces 20 and 22, no part of the rib portion 16 protrudes from the gap between the pieces 20 and 22; that is, a flush relationship is maintained between the exterior sides of the pieces 20 and 22. As a result of this feature of the present invention, the finishing process is relatively simplified.

During the finishing process, finishing tape 28 is applied to the exterior sides of the pieces 20 and 22 so as to cover the gap between the end or abutting portions of the pieces 20 and 22, and a finishing compound 30 is applied over the finishing tape 28, thereby establishing a smooth surface which conceals the fact that joinder of the pieces 20 and 22 by use of the device 10 has taken place. That is to say, an unbroken appearance in the finished wall structure is provided by virtue of employment of the device of the present invention.

It should be noted that the device 10 is preferably sufficiently rigid to substitute for traditional wooden studs normally found in building structures, thereby enabling one to employ the device 10 at a wall location in which no stud is provided, or to employ the device 10 as a substitute for a conventional wooden stud at an intermediate location of the wall.

In addition, as previously mentioned, the device 10 of the present invention can be employed in connection with repairing or patching a damaged wall section. In that regard, the device 10 is, in a preferred embodiment, able to be cut to a size necessary to repair or patch such a damaged wall section, even where the damaged wall section is smaller than a standard for 8'×8' wall board section.

Finally, the device 10 of the present invention can be used as a sealing joist for reinforcement of ceiling panels against sag, especially where a suspended ceiling is in place. In such an application, numerous devices 10 are installed at predetermined intervals along the perimeter of ceiling panels, thereby providing the needed reinforcement for suspended ceiling panels.

The device 10 can be formed of any suitable material and in any suitable size. However, preferably, the device 10 is made of galvanized steel, and is manufactured in lengths of approximately 8 feet or 12 feet, in correspondence to the lengths of the edges of the sheet material pieces to be joined.

While preferred forms and arrangements have been shown in illustrating the invention, it is to be understood the various changes and modifications can be made without departing from the spirit and scope of this disclosure.

I claim:

1. A device for joining and supporting two pieces of laterally disposed sheet material free from the use of a supporting stud, said device comprising first and second flange portions and a rib disposed between and interconnecting said first and second flange portions, said first and second flange portions defining a plane thereof, said rib extending in a direction perpendicular to the plane of said first and second flange portions;

wherein said device is positioned so that each of said first and second flange portions lies flat against an interior side of a respective one of said two pieces of sheet material and said rib is disposed between adjacent ends of said two pieces of sheet material;

said device further comprising fastener means, one for each of said first and second flange portions, for interconnecting each of said two pieces of sheet material to said first and second flange portions, respectively, so that said first and second flange portions provide sole support for adjacent ends of said two pieces of sheet material, each said fastener means passing from an exterior side of, and through, said respective one of said two pieces of sheet material;

wherein each of said first and second flange portions has at least one preformed hole formed therein, each said fastener means having an end which comes to rest in said at least one preformed hole in a respective one of said first and second flange portions.

2. The device of claim 1, wherein said rib has a length less than a thickness of each of said two pieces of sheet material.

3. The device of claim 1, wherein each of said first and second flange portions has a plurality of holes preformed therein, whereby to assist in connection of said fastener means to said first and second flange portions.

4. The device of claim 1, wherein said fastener means comprises one of steel studs and drywall screws.

5. The device of claim 1, wherein said fastener means have a length at least equal to a combined thickness of any one of said two pieces of sheet material and any one of said first and second flange portions.

6. The device of claim 1, wherein said first and second flange portions and said rib are formed from galvanized steel.

7. A method for joining and supporting two pieces of laterally disposed sheet material free from the use of a supporting stud, said method comprising the steps of:

providing a joinder device having first and second flange portions and a rib disposed between and interconnecting said first and second flange portions;

providing each of said first and second flange portions with at least one preformed hole formed therein;

positioning said device relative to said two pieces of sheet material so that each of said first and second flange portions lies flat against an interior side of a respective one of said two pieces of sheet material and said rib is disposed between adjacent ends of said two pieces of sheet material;

driving fasteners from an exterior side of, and through, each of said two pieces of sheet material; and anchoring distal ends of said fasteners in said at least one preformed hole in said first and second flange portions so that said first and second flange portions provide sole support for said adjacent ends of said two pieces of sheet material.

8. The method of claim 7, wherein said first and second flange portions define a plane thereof, and wherein said joinder device is positioned so that said rib extends in a direction perpendicular to the plane of said first and second flange portions.

9. The method of claim 7, wherein said rib is provided with a length which is less than a thickness of each of said two pieces of sheet material.

10. The method of claim 6, wherein each of said first and second flange portions is provided with a plurality of preformed holes therein, whereby to assist in anchoring said distal ends of said fasteners in said first and second flange portions.

11. The method of claim 7, wherein said fasteners comprise one of steel studs and drywall screws.

12. The method of claim 7, wherein said fasteners are utilized with a length at least equal to a combined thickness of said two pieces of sheet material and said first and second flange portions, respectively.

13. The method of claim 7, wherein said first and second flange portions and said rib are formed from galvanized steel.

* * * * *